United States Patent [19]

Bennett

[11] 4,405,157

[45] Sep. 20, 1983

[54] SURVEY DATA COLLECTING SYSTEM

[76] Inventor: Robert C. Bennett, 727 Decatur Dr., Mount Laurel, N.J. 08054

[21] Appl. No.: 354,452

[22] Filed: Mar. 3, 1982

[51] Int. Cl.[3] ..... B42D 15/00

[52] U.S. Cl. ..... 283/58; 281/38; 434/363

[58] Field of Search ..... 283/1 A, 36, 66 R, 58, 283/63 R, 59, 63 A, 57; 282/22 R, 22 A, 23 R, 23 A, 24 R, 24 A; 281/38; 434/326, 363

[56] References Cited

U.S. PATENT DOCUMENTS 2,267,052 12/1941 Stockton ..... 283/63 A 3,266,049 8/1966 Parmenter ..... 434/363

*Primary Examiner*—Paul A. Bell

*Assistant Examiner*—John S. Brown

*Attorney, Agent, or Firm*—Duffield & Lehrer

[57] ABSTRACT

A survey data collecting system includes a booklet having front and back covers and a plurality of intermediate pages. The back cover is perforated to form a negotiable check, the face of which is on the outer surface of the back cover. The inner surface of the check has several columns of spaces thereon for indicating answers to questions which are written on the intermediate leaves and on the remaining portion of the back cover. The intermediate leaves decrease in width so that each succeeding leaf covers one less column of spaces than the preceding one.

4 Claims, 3 Drawing Figures

SURVEY DATA COLLECTING SYSTEM

BACKGROUND OF THE INVENTION

The present invention is directed toward a survey data collecting system and more particularly toward such a system wherein the data can be initially recorded on the back of a negotiable check so that the same can be returned to the survey or through standard banking channels.

The collection of data by surveys has been utilized for various different purposes in numerous different fields for many years. In some cases, surveys are taken in person but in those surveys covering larger populations, the only practical way of collecting data is through the use of the mails.

It has been a common practice for surveyors, pollsters and other individuals and companies who wish to collect data to send a survey or questionnaire through the mails to selected recipients with a request that they complete and return the same. Unfortunately, many of these surveys are simply tossed away and are not answered.

Attempts have been made at providing incentives for persons to answer surveys and questionnaires. One such incentive is the inclusion of a token amount of money such as a dollar bill or the like. While this has improved response, it does not guarantee that the survey will be answered. Furthermore, this can be quite costly. The costs are increased even more since the respondent must be provided with a return envelope and return postage.

In an attempt to reduce costs, the idea was conceived to utilize the back side of a negotiable check such as a bank check to record answers to survey questions. The check was in a nominal amount such as a dollar and made payable to the respondent. After the questions on the reverse side of the check were answered, the check could then be deposited or cashed and through normal banking channels would eventually be returned to the payer of the check which was the company requesting the data. This clearly reduced costs since no return postage or envelope were needed and a dollar was paid only for those checks which were returned.

This concept, while quite successful, was also somewhat limited in use. The primary reason for the limitation is the fact that only a limited amount of data could be recorded on the back of a check. With the prior art system, both the questions and answers or at least a portion of the questions were printed on the back of the check. Since the amount of space is limited, only a small number of questions could appear on the check. If more questions were desired, the type would have to be so small so as to be difficult to read.

SUMMARY OF THE INVENTION

The present invention is believed to overcome the deficiencies of the prior art described above and provides a survey data collecting system which is capable of recording a substantially increased amount of data on the back surface of the check. The system includes a booklet having front and back covers and a plurality of intermediate pages. The back cover is perforated to form a negotiable check, the face of which is on the outer surface of the back cover. The inner surface of the check has several columns of spaces thereon for indicating answers to questions which are written on the intermediate leaves and on the remaining portion of the back cover. The intermediate leaves decrease in width so that each succeeding leaf covers one less column of spaces than the preceding one.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
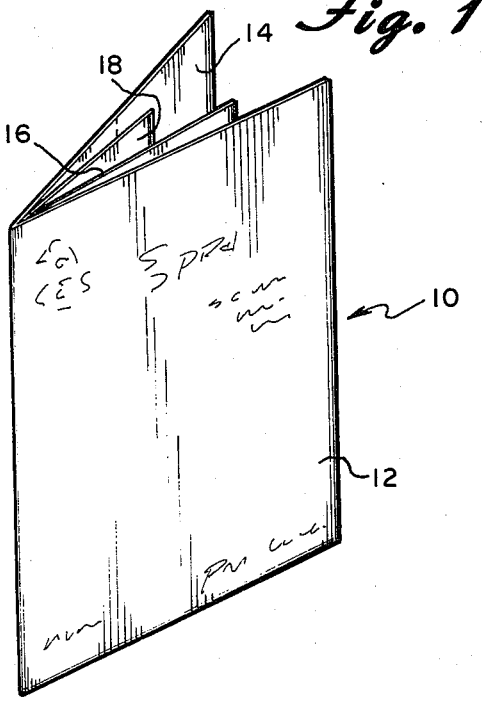
FIG. 1 is a front perspective view of the survey data collecting system constructed in accordance with the principles of the present invention.

Referring now to the drawing in detail wherein like reference numerals have been used throughout the various figures to designate like elements, there is shown in FIG. 1 a perspective view of a survey data collecting system constructed in accordance with the principles of the present invention and designated generally as 10. The system 10 is comprised essentially of a booklet having a front page or leaf 12, a back leaf 14 and a plurality of intermediate leaves 16 and 18. All of the leaves have a height of about eight inches which is approximately the length of a standard size business check. The widths of the front leaf 12 and back leaf 14 are substantially the same. The intermediate leaves 16 and 18, however, have widths which differ from each other and which are smaller than the front and back leaves for the reasons which will become more apparent hereinafter.

Figure 2:
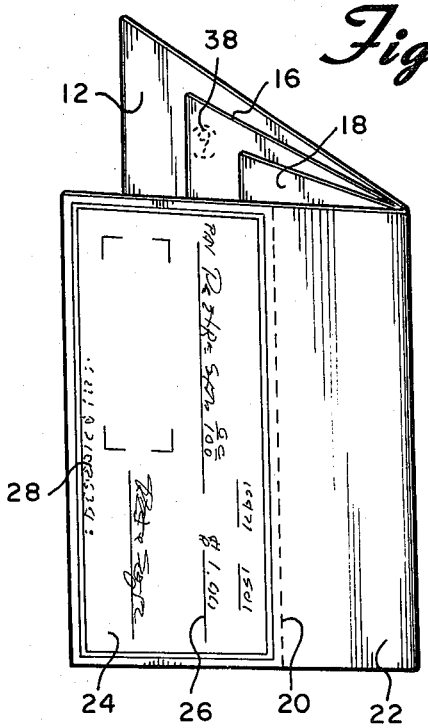
FIG. 2 is a rear perspective view thereof.

As shown most clearly in FIG. 2, the back leaf 14 is perforated at 20 throughout the height thereof and intermediate its width so as to form a first portion 22 which is attached by the binding to the front leaf 12 and a second portion 24 which is remote therefrom. The rear side of the second portion 24 which is the side shown in FIG. 2 has various indicia 26 printed thereon to form a bank check. The indicia 28 along the edge of the check are printed in magnetic ink which is standard for bank checks. This check is intended to be a negotiable instrument and can be negotiated and used like any other check by detaching the second portion 24 from the first portion 22 along the perforation 20.

Figure 3:
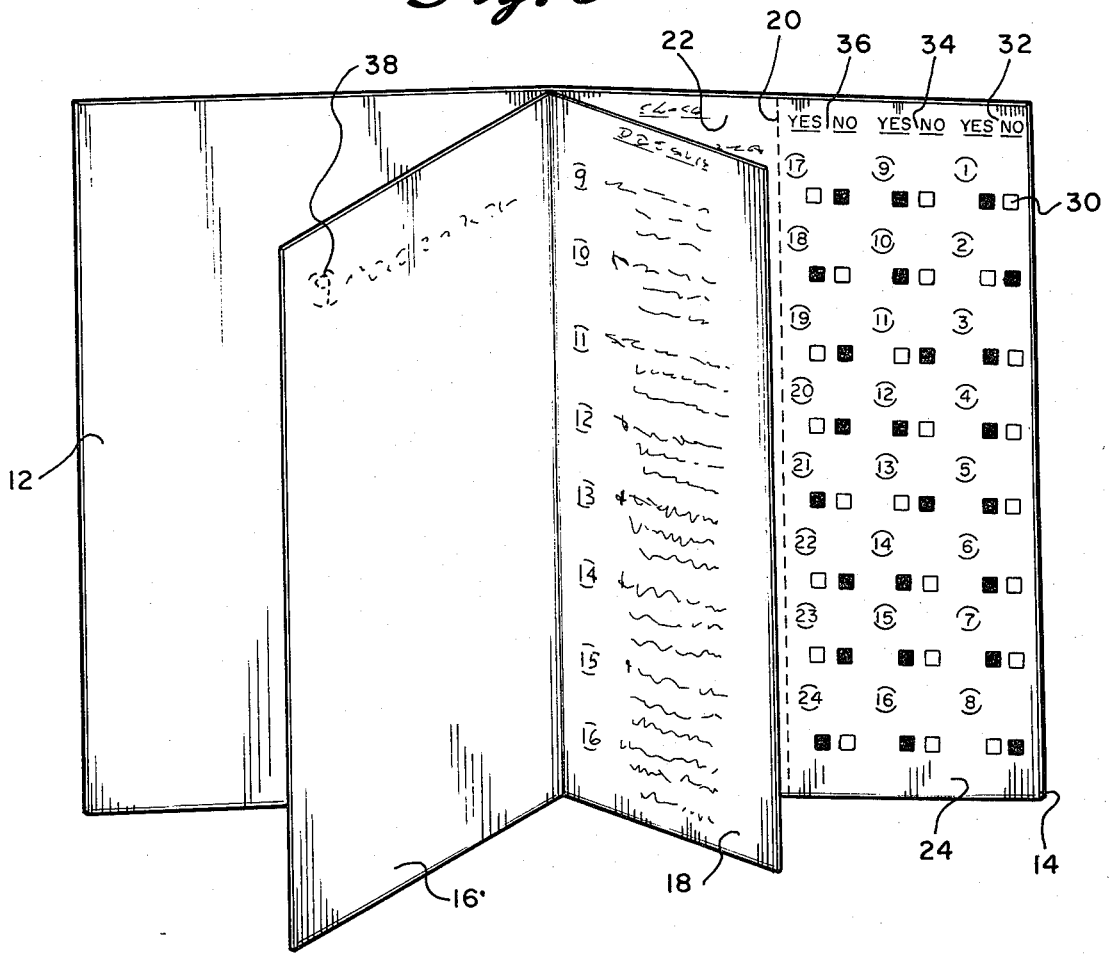
FIG. 3 is a perspective view showing the same in a substantially open position.

FIG. 3 shows the front side of the second portion 24 of the back leaf 14. Printed on this side of the portion 24 which is, in effect, the back side of the check, are a plurality of spaces or boxes 30 arranged in three columns: 32, 34 and 36. Each column is actually comprised of two columns of boxes 30, one under the heading "Yes" and one under the heading "No." However, for ease of description, each pair of boxes are being considered to be in a single column. These boxes serve as spaces for answers and are consecutively numbered starting with the top boxes in the right-hand column 32 downwardly as shown. Thus, in the embodiment shown in FIG. 3, answer boxes 1 through 8 are in column 32, answer boxes 9 through 16 are in column 34 and answer boxes 17 through 24 are in column 36. It should be readily apparent that these numbers are by way of example only and that it is possible to significantly increase the number of boxes in a column. It is also possible to increase the number of columns.

For the reasons which will become more apparent hereinafter, the number of intermediate leaves is one less than the number of answer columns. Thus, in the embodiment shown, there are three answer columns, 32, 34 and 36 and accordingly there are two intermediate leaves 16 and 18.

The front sides or surfaces of the intermediate leaves 16 and 18 and of the first portion 22 of the back leaf 14 have a series of questions thereon to which answers are being requested. The questions are arranged vertically one above the other so as to correspond with the answer spaces. In the embodiment shown, questions 1 through 8 appear on the front side of intermediate leaf 16, questions 9 through 16 appear on the front side of the intermediate leaf 18 and questions 17 through 24 appear on the front side of the portion 24 of the back leaf 14. It should be readily apparent that if more space is needed for the questions, they can begin on the back side of the preceding leaf. For example, question 9 shown at the top of the front side of intermediate leaf 18 could begin at the top of the back side of intermediate leaf 16 at point 38 and continue straight across.

As stated above, the intermediate leaves 16 and 18 are of different widths. The difference is equal to the space between adjoining columns 32, 34 or 36. Furthermore, the leaves are arranged in descending order of width from the front leaf 12. Thus, it should be readily apparent that when the intermediate leaves are all in a closed position, i.e. moved flat against the back leaf 14, intermediate leaf 16 covers all of the answer columns except column 32. In this position, each of the questions appearing on the front side of the intermediate leaf 16 are in alignment with the answer spaces 1 through 8 and the questions can be answered thereo as indicated. After the first eight questions are answered, intermediate leaf 16 is turned and with intermediate leaf 18 overlying column 36, questions 9 through 16 on the front side of intermediate leaf 18 are in proper alignment with the answer spaces in column 34. Intermediate leaf 18 is then turned to expose column 36 so that questions 17 through 24 printed on the front surface of portion 22 can be answered. When all of the questions have been answered, the check can be detached along perforation 20 and cashed.

It should be readily apparent that the numbers of questions, numbers of columns and numbers of intermediate leaves shown in the drawing are by way of example only and that the quantities of these various elements can be decreased if desired or can be significantly increased. Furthermore, while in the preferred embodiment, it is shown that the answers can be marked directly on the rear surface of the check, it is also possible to place one or more intermediate pages just before the back leaf 14 which intermediate pages could include carbon paper or some similar transfer substance so that answers would be indirectly placed in the various answer spaces.

The present invention may be embodied in other specific forms without departing from the spirit or essential attributes thereof and accordingly, reference should be made to the appended claims rather than to the foregoing specification as indicating the scope of the invention.

I claim:

1. A survey data collecting system comprising:

a booklet having a front leaf, a back leaf and at least one intermediate leaf, the height and width of said front and back leaves being substantially identical, the height of said intermediate leaf being substantially the same as said front and back leaves but the width thereof being somewhat less;

said back leaf being perforated throughout the height thereof intermediate its width so as to form a first portion adjacent the front leaf and a second portion remote therefrom;

the rear side of said second portion having indicia printed thereon to form a check, at least part of said indicia being along an edge thereof and being comprised of magnetic ink;

the front side of said second portion having at least first and second columns of spaces thereon for indicating answers to questions printed on the front side of said first portion and on the front surface of said intermediate leaf;

the width of said intermediate leaf being sufficient to cover said first column of spaces but not said second column.

2. The invention as claimed in claim 1 including a plurality of intermediate leaves, said intermediate leaves being of different widths and being arranged in order of decreasing width starting after said front leaf.

3. The invention as claimed in claim 2 wherein said front side of said second portion has one more column of said spaces than the number of said intermediate leaves.

4. The invention as claimed in claim 2 wherein the widths of said intermediate leaves decrease in such a way that each succeeding leaf covers one less column of spaces than the preceding intermediate leaf.

* * * * *